US009824628B2

(12) United States Patent
Na

(10) Patent No.: US 9,824,628 B2
(45) Date of Patent: Nov. 21, 2017

(54) DISPLAY DEVICE

(71) Applicant: SAMSUNG DISPLAY CO., LTD., Yongin, Gyeonggi-Do (KR)

(72) Inventor: Ji Su Na, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 127 days.

(21) Appl. No.: 14/733,416

(22) Filed: Jun. 8, 2015

(65) Prior Publication Data

US 2016/0189585 A1 Jun. 30, 2016

(30) Foreign Application Priority Data

Dec. 31, 2014 (KR) ..... 10-2014-0194767

(51) Int. Cl.
*G09G 3/3233* (2016.01)

(52) U.S. Cl.
CPC ... *G09G 3/3233* (2013.01); *G09G 2300/0842* (2013.01); *G09G 2300/0861* (2013.01); *G09G 2310/08* (2013.01); *G09G 2330/08* (2013.01); *G09G 2330/10* (2013.01); *G09G 2330/12* (2013.01); *G09G 2380/02* (2013.01)

(58) Field of Classification Search
CPC ..... G09G 3/20; G09G 2300/0413; G09G 2310/08; G09G 2380/02; G09G 2330/08; G09G 2330/10; G02F 2201/506
See application file for complete search history.

(56) References Cited

U.S. PATENT DOCUMENTS 9,147,723 B1 * 9/2015 Lee ..... G09G 3/006
2013/0078884 A1 * 3/2013 Tseng ..... G02F 1/137 445/24
2014/0347401 A1 * 11/2014 Hwang ..... G09G 3/3233 345/690

FOREIGN PATENT DOCUMENTS

KR 10-2005-0048931 A 5/2005
KR 10-2008-0110378 A 12/2008
KR 10-2013-0064485 A 6/2013
KR 10-2013-0081473 A 7/2013

* cited by examiner

*Primary Examiner* — Jennifer Mehmood
*Assistant Examiner* — Parul Gupta
(74) *Attorney, Agent, or Firm* — Lewis Roca Rothgerber Christie LLP

(57) ABSTRACT

A display device includes: a first pixel including a display element, a pixel circuit to provide a driving signal to the display element, a first transistor to control a connection between the pixel circuit and the display element, and a second transistor to control a connection between the display element and a repair line; a second pixel including a repair circuit to provide the driving signal to the repair line; and a repair control element connected to first and second control lines that are connected to gate electrodes of the first and second transistors, respectively, and configured to control the first and second transistors according to a repair control signal provided by a controller.

4 Claims, 9 Drawing Sheets

DISPLAY DEVICE

CROSS-REFERENCE TO RELATED APPLICATION

This application claims priority to and the benefit of Korean Patent Application No. 10-2014-0194767, filed on Dec. 31, 2014 in the Korean Intellectual Property Office, the entire content of which is incorporated herein by reference.

BACKGROUND

1. Field

Aspects of embodiments of the present invention relate to a display device.

2. Description of the Related Art

Display devices are devices that visually present data. Examples of display devices include liquid crystal display (LCD) devices, electrophoretic display (EPD) devices, organic light-emitting display devices, inorganic electroluminescent (EL) display devices, field emission display (FED) devices, surface-conduction electron-emitter display (SED) devices, plasma display devices, and cathode ray tube (CRT) display devices.

A display device may include a plurality of pixels arranged in a matrix form, and may be classified into a passive matrix display device or an active matrix display device according to a driving method of the pixels. Active matrix display devices consume less power than passive matrix display devices, and are thus more suitable than passive matrix display devices for the realization of large-size displays. In addition, active matrix display devices provide higher resolution than passive matrix display devices. Active matrix display devices may include pixel driving circuits connected to, for example, liquid crystal elements or organic light-emitting diodes (OLEDs).

A pixel driving circuit includes at least one thin-film transistor (TFT) and a capacitor. During the driving of the pixel driving circuit, a defect may occur in the TFT or the capacitor, and this becomes more apparent in a flexible display device. In response to a defect occurring in the pixel driving circuit, the OLED or the liquid crystal element connected to the defective pixel driving circuit may cause a dark- or bright-spot defect.

SUMMARY

Embodiments of the present invention relate to a display device, and more particularly, to a repairable display device. Embodiments of the present invention provide for a display device capable of repairing defective pixels so that the defective pixels may be driven normally.

However, the present invention is not restricted to embodiments set forth herein. The above and other embodiments of the present invention will become more apparent to one of ordinary skill in the art to which the invention pertains by referencing the detailed description of example embodiments given below.

According to an embodiment of the present invention, a display device is provided. The display device includes: a first pixel including a display element, a pixel circuit to provide a driving signal to the display element, a first transistor to control a connection between the pixel circuit and the display element, and a second transistor to control a connection between the display element and a repair line; a second pixel including a repair circuit to provide the driving signal to the repair line; and a repair control element connected to first and second control lines that are connected to gate electrodes of the first and second transistors, respectively, and configured to control the first and second transistors according to a repair control signal provided by a controller.

The controller may be configured to provide the repair control signal as a low-level voltage or a high-level voltage at intervals of a single horizontal period. The repair control element may be further configured to turn off the first transistor and turn on the second transistor in response to the repair control signal with the high-level voltage.

The repair control element may be further configured to turn off the second transistor and turn on the first transistor in response to the repair control signal with the low-level voltage.

The display element may be configured to receive the driving signal from the repair circuit via the second transistor.

The display device may further include a display panel having a display area to display an image and a non-display area that surrounds the display area, wherein the first pixel is in the display area and the second pixel is in the non-display area.

The repair control element may be in the non-display area.

The controller may be configured to provide the repair control signal with a high-level voltage concurrently with a scan signal being applied to the first pixel.

The repair control element may include: third through fifth transistors each having a first electrode connected to a repair control line configured to receive the repair control signal; a sixth transistor having a second electrode connected to the repair control line and configured to turn on by an i-th scan signal being applied to the first pixel; a seventh transistor having a gate electrode connected to a first electrode of the sixth transistor, a first electrode configured to receive a first control signal with a low-level voltage, and a second electrode connected to the first control line; an eighth transistor having a gate electrode connected to a second electrode of the third transistor, a second electrode configured to receive a second control signal with the low-level voltage, and a first electrode connected to the second control line; a first capacitor connected between the second electrode of the third transistor and a second electrode of the fourth transistor; and a second capacitor connected between the second electrode and the gate electrode of the seventh transistor.

The third transistor may be configured to turn on by an (i−1)-th scan signal preceding the i-th scan signal, the fourth transistor may be configured to turn on by the i-th scan signal, and the fifth transistor may be configured to turn on by an (i+1)-th scan signal following the i-th scan signal.

After a defect occurs in the pixel circuit of the first pixel, the controller may be configured to sequentially output the repair control signal with the low-level voltage, the repair control signal with a high-level voltage, and the repair control signal with the low-level voltage concurrently with the (i−1)-th scan signal, the i-th scan signal, and the (i+1)-th scan signal, respectively.

The seventh transistor may be configured to turn off by the repair control signal with a high-level voltage being provided thereto via the sixth transistor.

The driving signal may be a driving current and the display element may be an organic light-emitting diode (OLED).

The driving signal may be a driving voltage and the display element may be a liquid crystal element including a pixel electrode, a common electrode configured to form an electric field with the pixel electrode, and a liquid crystal layer whose alignment is configured to vary according to the electric field.

The first and second transistors may be p-channel field effect transistors (FETs).

According to another embodiment of the present invention, a display device is provided. The display device includes: a display panel including a display area in which a plurality of pixels are arranged and a dummy pixel area in which a plurality of dummy pixels are arranged, wherein each of the pixels includes a display element and a pixel circuit to drive the display element, and each of the dummy pixels includes a repair circuit having a same structure as the pixel circuit; a scan driver to provide a scan signal to the display panel; a repair controller to cut off a connection between the pixel circuit and the display element of one of the pixels where a defect has occurred according to a repair control signal output at intervals of a single horizontal period as a low-level voltage or a high-level voltage, and configured to connect the display element of the defective one of the pixels to the repair circuit of a corresponding one of the dummy pixels; and a controller to control the scan driver and output the repair control signal.

The controller may be configured to provide the repair control signal with the high-level voltage concurrently with a scan signal being applied to the one of the pixels.

The repair controller may be configured to cut off the connection between the pixel circuit and the display element of each pixel of a row of the pixels including the one of the pixels, and to connect the display elements of the pixels of the row of the pixels to the repair circuits of corresponding ones of the dummy pixels.

The dummy pixel area may be in a non-display area that surrounds the display area.

A connection between the pixel circuit and the display element of the defective one of the pixels may be configured to be cut off in response to the repair control signal with the high-level voltage. The display element of the defective one of the pixels may be further configured to connect to the repair circuit of the corresponding one of the dummy pixels.

The display panel may include a plurality of scan lines and a plurality of data lines that define the pixels. The repair controller may include a repair control line to provide the repair control signal, and a plurality of repair control elements connected to the repair control line. The repair control elements may correspond to the scan lines and be configured to control a corresponding plurality of rows of pixels connected to respective ones of the scan lines.

According to the above and other embodiments, no pixel defects may occur even when defects occur in the driving circuits of the pixels. Accordingly, it is possible to improve yield by reducing pixel defects. Other features and embodiments will be apparent from the following detailed description, the drawings, and the claims.

DETAILED DESCRIPTION

Figure 1:
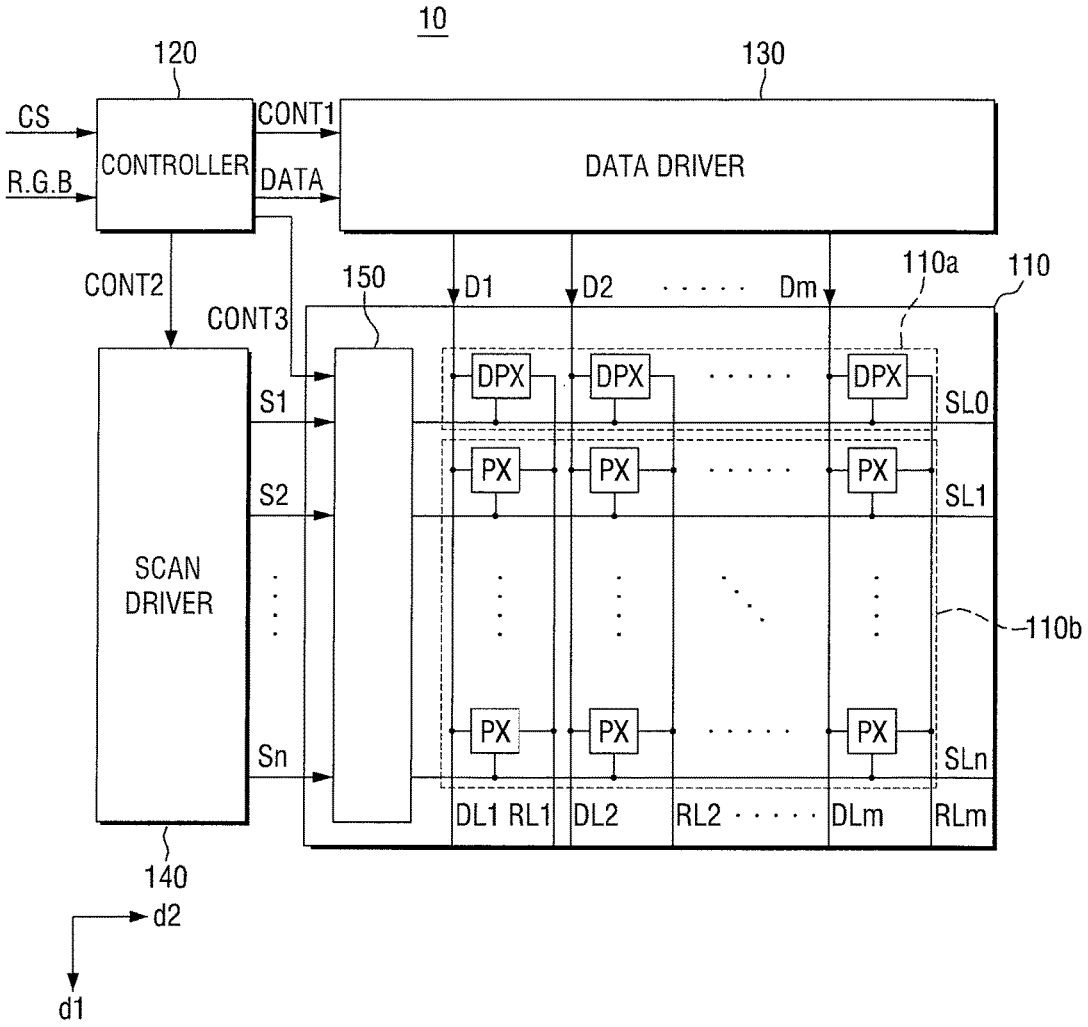
FIG. 1 is a schematic diagram of a display device according to an embodiment of the present invention.

Aspects and features of the present invention and methods of accomplishing these aspects and features may be understood more readily by reference to the following detailed description of example embodiments and the accompanying drawings. The present invention may, however, be embodied in many different forms and should not be construed as being limited to the embodiments set forth herein. Rather, these embodiments are provided to more fully convey concepts of the present invention to those skilled in the art, and the present invention will only be defined by the appended claims and their equivalents. Like reference numerals refer to like elements throughout the specification.

The terminology used herein is primarily for describing particular embodiments and is not intended to be limiting of the present invention. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to", or "coupled to" another element or layer, it may be directly on, connected to, or coupled to the other element or layer, or intervening elements or layers may also be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers, and/or sections should not be limited by these terms. These terms are used primarily to distinguish one element, component, region, layer, or section from another element, component, region, layer, or section. Thus, a first element, component, region, layer, or section discussed below could be termed a second element, component, region, layer, or section without departing from the teachings of the present invention.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" may encompass both an orientation of above and below. The device may be otherwise oriented (rotated 90 degrees or at other orientations) and the spatially relative descriptors used herein interpreted accordingly.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these embodiments should not be construed as limited to the particular shapes of regions illustrated herein but are meant to include variations in shapes that result, for example, from manufacturing. For example, an implanted region illustrated as a rectangle may have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Herein, the use of the term "may," when describing embodiments of the present invention, refers to "one or more embodiments of the present invention." In addition, the use of alternative language, such as "or," when describing embodiments of the present invention, refers to "one or more embodiments of the present invention" for each corresponding item listed.

The display device and/or any other relevant devices or components according to embodiments of the present invention described herein may be implemented utilizing any suitable hardware, firmware (e.g., an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate as display device.

Further, the various components of the display device may be a process or thread, running on one or more processors, in one or more computing devices, executing computer program instructions and interacting with other system components for performing the various functionalities described herein. The computer program instructions are stored in a memory that may be implemented in a computing device using a standard memory device, such as, for example, a random access memory (RAM). The computer program instructions may also be stored in other non-transitory computer readable media such as, for example, a CD-ROM, flash drive, or the like. In addition, a person of skill in the art should recognize that the functionality of various computing devices may be combined or integrated into a single computing device, or the functionality of a particular computing device may be distributed across one or more other computing devices without departing from the scope of the present invention.

Exemplary embodiments will hereinafter be described with reference to the accompanying drawings.

Figure 2:
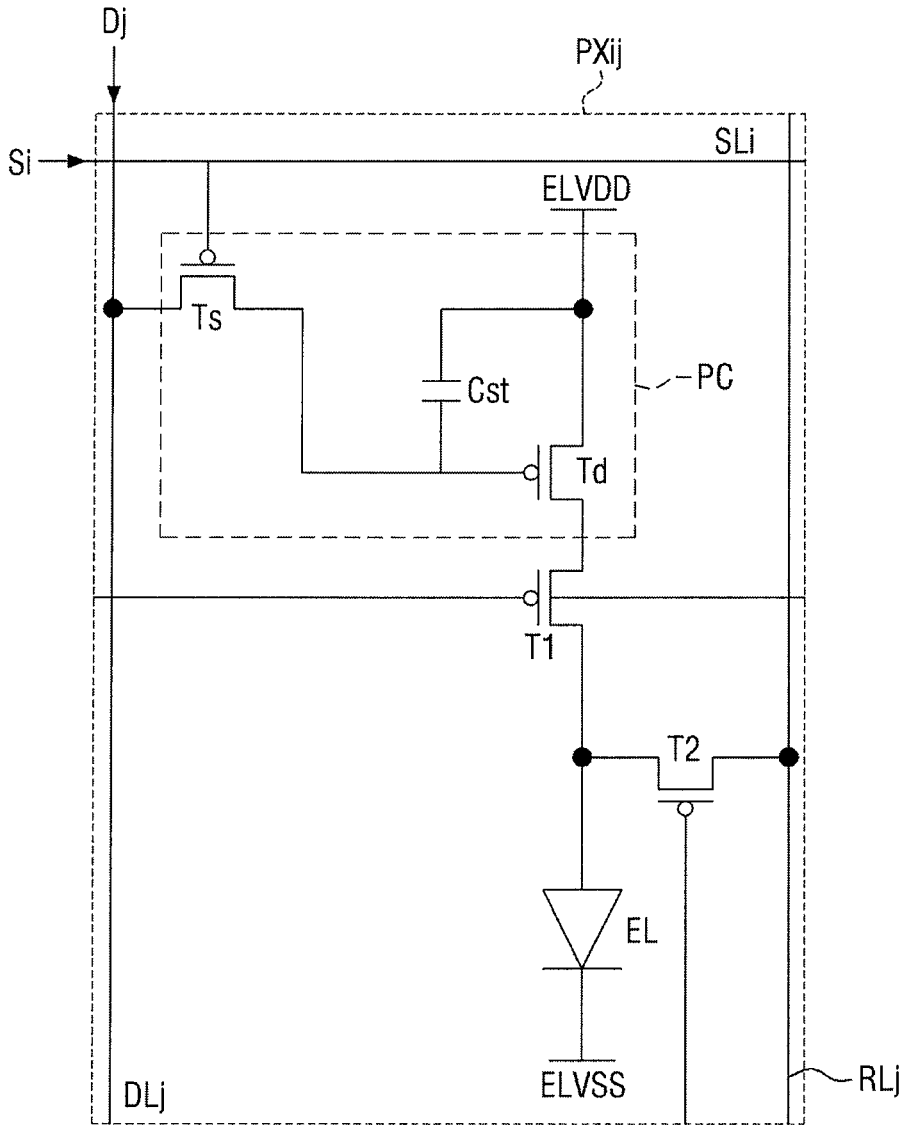
FIG. 2 is a circuit diagram of an example pixel of the display device of FIG. 1 according to an embodiment of the present invention.
Figure 3:
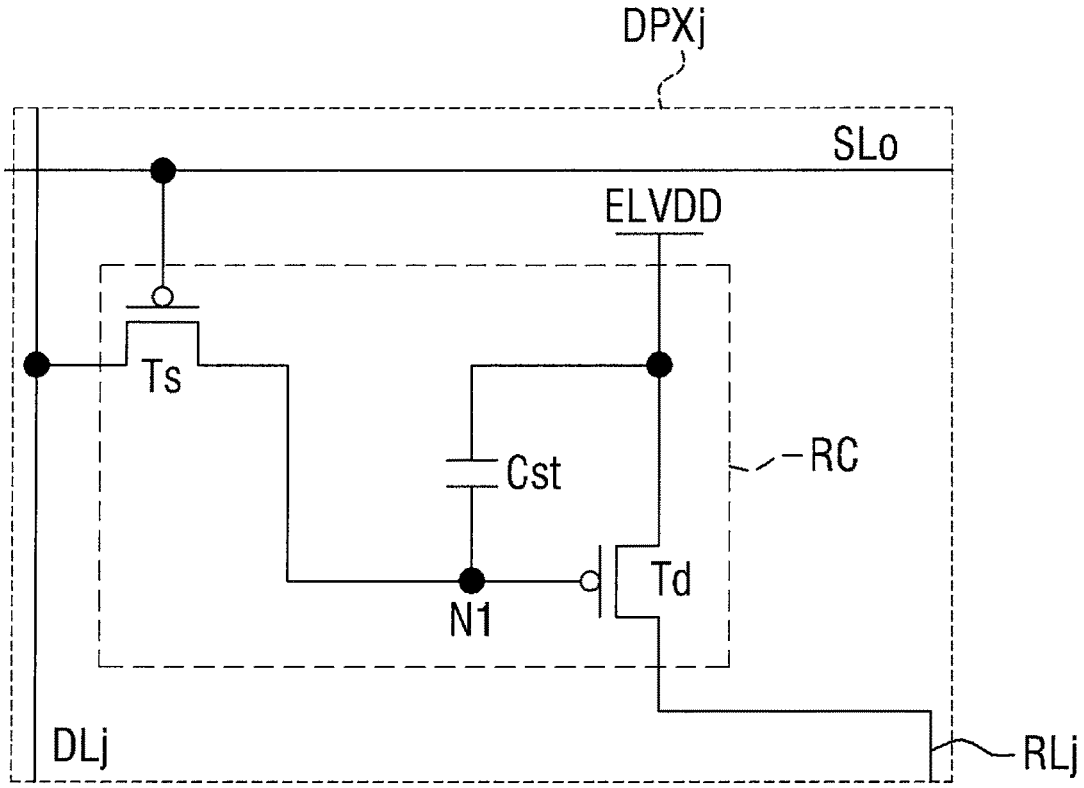
FIG. 3 is a circuit diagram of an example dummy pixel of the display device of FIG. 1 according to an embodiment of the present invention.

FIG. 1 is a schematic diagram of a display device 10 according to an embodiment of the present invention, FIG. 2 is a circuit diagram of an example pixel PXij of the display device 10 of FIG. 1 according to an embodiment of the present invention, and FIG. 3 is a circuit diagram of an example dummy pixel DPXj of the display device 10 of FIG. 1 according to an embodiment of the present invention.

Referring to FIG. 1, the display device 10 includes a display panel 110, a controller 120, a data driver 130, a scan driver 140, and a repair controller 150.

The display panel 110 may be a region where an image is displayed. The display panel 110, which is a panel for displaying an image, may be, for example, a liquid crystal display (LCD) panel, an electrophoretic display panel, an organic light-emitting diode (OLED) display panel, a light-emitting diode (LED) display panel, an inorganic electroluminescent (EL) display panel, a field emission display (FED) display panel, a surface-conduction electron-emitter display (SED) display panel, a plasma display panel (PDP), or the like. In the description that follows, it is assumed that the display device 10 and the display panel 110 are an OLED display device and an OLED display panel, respectively, but the present invention is not limited thereto. In other embodiments, various display devices and display panels, other than an OLED display device and an OLED display panel, may be used without departing from the spirit and scope of the present invention.

The display panel 110 may include a plurality of scan lines SL1, SL2, . . . , SLn, a plurality of data lines DL1, DL2, . . . , DLm, which cross the scan lines SL1, SL2, . . . , SLn, and a plurality of pixels PX each connected to one of the scan lines SL1, SL2, . . . , SLn and one of the data lines DL1, DL2, . . . , DLm, wherein n and m are natural numbers. The data lines DL1, DL2, . . . , DLm may cross the scan lines SL1, SL2, . . . , SLn. For example, the data lines DL1, DL2, . . . , DLm may extend in a first direction d1, and the scan lines SL1, SL2, . . . , SLn may extend in a second direction d2 that crosses the first direction d1. The first direction d1 may be a column direction, and the second direction d2 may be a row direction. The scan lines SL1, SL2, . . . , SLn may include first through n-th scan lines SL1 through SLn sequentially arranged along the second direction d2. The data lines DL1, DL2, . . . , DLm may include first through m-th data lines DL1 through DLm sequentially arranged along the first direction d1.

The pixels PX may be arranged in a matrix form. Each of the pixels PX may be connected to one of the scan lines SL1, SL2, . . . , SLn and one of the data lines DL1, DL2, . . . , DLm. Each of the pixels PX may receive a scan signal via one of the scan lines SL1, SL2, . . . , SLn connected thereto, and may receive a data voltage via one of the data lines DL1, DL2, . . . , DLm connected thereto. That is, a plurality of scan signals S1, S2, . . . , Sn to be applied to the pixels PX, may be applied to the scan lines SL1, SL2, . . . , SLn, respectively, and a plurality of data voltages D1, D2, . . . , Dm may be applied to the data lines DL1, DL2, . . . , DLm, respectively.

Each of the pixels PX may display an image (or portion thereof) corresponding to a data voltage applied thereto. Therefore, each of the pixels PX may include a pixel circuit PC provided with a scan signal and a data voltage, and a display element EL driven by the pixel circuit PC. The display element EL may be an OLED, but the present invention is not limited thereto. In another embodiment, the display element EL may be a liquid crystal element defined for each pixel PX. That is, the display element EL may be a liquid crystal element including a pixel electrode, a common electrode forming an electric field together with the pixel electrode, and a liquid crystal layer with an alignment that varies according to the electric field.

The display panel 110 may also include a plurality of repair lines RL1, RL2, . . . , RLm. The repair lines RL1, RL2, . . . , RLm may extend in the same direction as the data lines DL1, DL2, . . . , DLm. The repair lines RL1, RL2, . . . , RLm may connect a plurality of columns of pixels PX respectively connected to the data lines DL1, DL2, . . . , DLm. For example, in an embodiment, a first repair line RL1 may connect a column of pixels PX connected to the first data line DL1.

The display panel 110 may include a display area 110*b* and a non-display area that surrounds the display area 110*b*. The display area 110*b* may be a region where the pixels PX are arranged. The display panel 110 may also include a plurality of dummy pixels DPX arranged in the non-display area. That is, a dummy pixel area 110*a*, in which the dummy pixels DPX are formed, may be provided on at least one side of the non-display area. As illustrated in FIG. 1, the dummy pixel area 110*a* may be formed along a first side of the display panel 110, but the present invention is not limited thereto. In other embodiments, the dummy pixel area 110*a* may be provided along a second side of the display panel 110 opposite to the first side of the display panel 110, or a third side of the display panel 110 perpendicular to the first side of the display panel 110. In still other embodiments, the dummy pixel area 110*a* may be provided along more than one side of the display panel 110.

The dummy pixel area 110*a* may include a row of dummy pixels DPX connected to at least one scan line. As illustrated in FIG. 1, the dummy pixels DPX may be connected to a zeroth scan line SL0, and may be disposed in the dummy pixel area 110*a*. Each of the dummy pixels DPX may include a repair circuit RC. Signals output by the repair circuits RC of the dummy pixels DPX may be provided to the repair lines RL1, RL2, . . . , RLm to which the dummy pixels DPX are respectively connected, and may thus be selectively provided to the pixels PX. In response to defects occurring in the pixel circuits PC of the pixels PX in the display area 110*b*, the repair circuits RC of the dummy pixels DPX, instead of the pixel circuits PC of the pixels PX, may drive the display elements EL of the pixels PX. For example, the repair circuits RC of the dummy pixels DPX may have the same structure as the pixel circuits PC of the pixels PX.

FIGS. 2 and 3 illustrate the structures of a pixel PX and a dummy pixel DPX, respectively. More specifically, FIG. 2 illustrates an example of a structure of a pixel PXij defined by an i-th scan line SLi and a j-th data line DLj, and FIG. 3 illustrates an example of a structure of a dummy pixel DPXj connected to the j-th data line DLj. The pixel PXij and the dummy pixel DPXj may both be connected to a j-th repair line RLj. The structures illustrated in FIGS. 2 and 3 may be directly applicable to the other pixels PX and the other dummy pixels DPX. However, the structures illustrated in FIGS. 2 and 3 are examples, and thus, the present invention is not limited thereto.

Referring to FIG. 2, the pixel PXij may include a pixel circuit PC, a display element EL, a first transistor T1 to control a connection between the pixel circuit PC and the display element EL, and a second transistor T2 to connect the display element EL and the j-th repair line RLj. The pixel circuit PC may include a control transistor Ts connected to the i-th scan line SLi, the j-th data line DLj, and a driving transistor Td, the driving transistor Td being connected between a first power supply ELVDD and the display element EL, and a capacitor Cst connected between a first electrode and a gate electrode of the driving transistor Td. A gate electrode of the control transistor Ts is connected to the i-th scan line SLi, and a first electrode of the control transistor Ts is connected to the j-th data line DLj. A second electrode of the control transistor Ts is connected to a first terminal of the capacitor Cst.

The term "first electrode", as used herein, may denote a source electrode or a drain electrode, and the term "second electrode", as used herein, may denote whichever of the source electrode and the drain electrode is not the first electrode. The control transistor Ts may be turned on in response to a scan signal Si being applied thereto via the i-th scan line SLi, and may supply a j-th data voltage Dj provided thereto via the j-th data line DLj to the capacitor Cst. Then, the capacitor Cst may be charged with a voltage corresponding to the j-th data voltage Dj. The gate electrode of the driving transistor Td is connected to the first terminal of the capacitor Cst, and the first electrode of the driving transistor Td is connected to a second terminal of the capacitor Cst and the first power supply ELVDD. The second electrode of the driving transistor Td is connected to an anode electrode of the display element EL. The driving transistor Td may control a driving current flowing from the first power supply ELVDD to a second power supply ELVSS via the display element EL according to the voltage stored in the capacitor Cst. Then, the display element EL may generate light corresponding to the driving current provided by the driving transistor Td.

A connection between the display element EL and the driving transistor Td may be controlled by the first transistor T1. That is, the first transistor T1 may be connected between the driving transistor Td and the display element EL. After a defect occurs in the pixel circuit PC, the first transistor T1 may be turned off to cut off the connection between the pixel circuit PC and the display element EL. Then, the display element EL may receive a driving signal from a repair circuit RC of the dummy pixel DPXj, instead of from the pixel circuit PC. If the display element EL is an OLED, the driving signal may be a driving current, but the present invention is not limited thereto. For example, in another embodiment, the display element EL is a liquid crystal element, and the driving signal may be a driving voltage. In the description that follows, it is assumed that the display element EL is an OLED, and the structure of the pixel circuit PC may vary depending on whether the display element EL is an OLED, a liquid crystal element, or some other pixel technology as would be apparent to one of ordinary skill.

The repair circuit RC of the dummy pixel DPXj may have the same structure as the pixel circuit PC of the pixel PXij. The repair circuit RC may include a control transistor Ts, a driving transistor Td, and a capacitor Cst. The dummy pixel DPXj may be selectively driven after a defect occurs in the pixel PXij in the display area 110*b*. More specifically, after a defect occurs in the pixel circuit PC of the pixel PXij, the repair circuit RC, instead of the pixel circuit PC of the pixel PXij, may provide a driving current to the display element EL of the pixel PXij.

Therefore, the i-th scan signal Si and the j-th data voltage Dj to be provided to the pixel circuit PC of the pixel PXij, may be provided to the dummy pixel DPXj, and the dummy pixel DPXj may generate a driving current corresponding to the j-th data voltage Dj, and may provide the driving current to the j-th repair line RLj. Then, the display element EL of the pixel PXij may receive the driving current via the j-th repair line RLj, and may generate light corresponding to the received driving current. The second transistor T2 connected between the j-th repair line RLj and the display element EL, may be turned on.

That is, after a defect occurs in the pixel circuit PC of the pixel PXij in the display area 110*b*, the connection between the pixel circuit PC and the display element EL of the pixel PXij may be cut off, and the display element EL may be connected to the j-th repair line RLj, and may emit light normally by receiving a driving current from the dummy pixel DPXj. Further, after a defect occurs in the pixel PXij, an entire pixel row connected to the same scan line as the pixel PXij may be excluded from an operation of the display device 10, and the dummy pixels DPX in the dummy pixel area 110*a* may be driven instead of the excluded pixel row. This switching operation will be described later in further detail.

Referring back to FIG. 1, the controller 120 may receive control signals CS and image signals "R.G.B." from an external system. The image signals "R.G.B" may include luminance information regarding the pixels PX. Luminance may have a predefined number of gray levels, for example, 1024, 256, or 64 gray levels. The control signal CS may include a vertical synchronization signal Vsync, a horizontal synchronization signal Hsync, a data enable signal DE, and a clock signal CLK. The controller 120 may generate first and second driving control signals CONT1 and CONT2, and image data "DATA" based on the image signals "R.G.B" and the control signal CS.

More specifically, the controller 120 may generate the image data "DATA" by dividing the image signals "R.G.B" in units of frames according to the vertical synchronization signal Vsync and dividing the image signals "R.G.B" in units of the scan lines SL1, SL2, . . . , SLn according to the horizontal synchronization signal Hsync. The controller 120 may output the image data "DATA" to the data driver 130 together with the first driving control signals CONT1. The controller 120 may transmit the second driving control signals CONT2 to the scan driver 140. The controller 120 may receive a repair initiation signal from an external source, and may then transmit a third driving control signal CONT3 to the repair controller 150.

The repair initiation signal may be chosen by a user or a system to be applied to the controller 120 after an abnormal operation of the pixels PX in the display area 110*b* is detected. The controller 120 may locate one or more pixels PX that operate abnormally, may generate the third driving control signal CONT3 and may transmit the third driving control signal CONT3 to the repair controller 150. The controller 120 may modify the second and third driving control signals CONT2 and CONT3 based on an operation of the dummy pixels DPX and may provide the modified second and third driving control signals CONT2 and CONT3 to the scan driver 140 and the repair controller 150, respectively.

The scan driver 140 may be connected to the scan lines SL1, SL2, . . . , SLn of the display panel 110, and may generate the scan signals S1, S2, . . . , Sn according to the second driving control signals CONT2. The scan driver 140 may sequentially apply a plurality of scan signals S1, S2, . . . , Sn with a gate-on voltage to the scan lines SL1, SL2, . . . , SLn, respectively. The scan signals S1, S2, . . . , Sn may be provided to the scan lines SL1, SL2, . . . , SLn, respectively. The scan signals S1, S2, . . . , Sn may also be provided to the repair controller 150. In response to a repair mode being activated, the scan driver 140 may provide a scan signal S0 for activating the dummy pixels DPX via the zeroth scan line SL0 to the dummy pixels DPX. The scan signal S0 may be provided to the dummy pixels DPX at the same time as (e.g., concurrently) when a scan signal is provided to a scan line connected to at least one inactivated pixel PX.

The data driver 130 may be connected to the data lines DL1, DL2, . . . , DLm of the display panel 110, and may generate the data voltages D1, D2, . . . , Dm by sampling and holding the image data "DATA" input thereto according to the first driving control signals CONT1 and converting the sampled-and-held image data into analog voltages. The data driver 130 may output the data voltages D1, D2, . . . , Dm to the data lines DL1, DL2, . . . , DLm, respectively.

The repair controller 150 may selectively connect a pixel PX where a defect has occurred and one of the dummy pixels DPX according to the third driving control signal CONT3. More specifically, the repair controller 150 may selectively connect the display element EL of the defective pixel PX and the repair circuit RC of one of the dummy pixels DPX. An entire pixel row connected to the same scan line as the defective pixel PX may be excluded from an operation of the display device 10, and the dummy pixels DPX may be driven, instead of the excluded pixel row. The structure and operation of the repair controller 150 will hereinafter be described in further detail.

Figure 4:
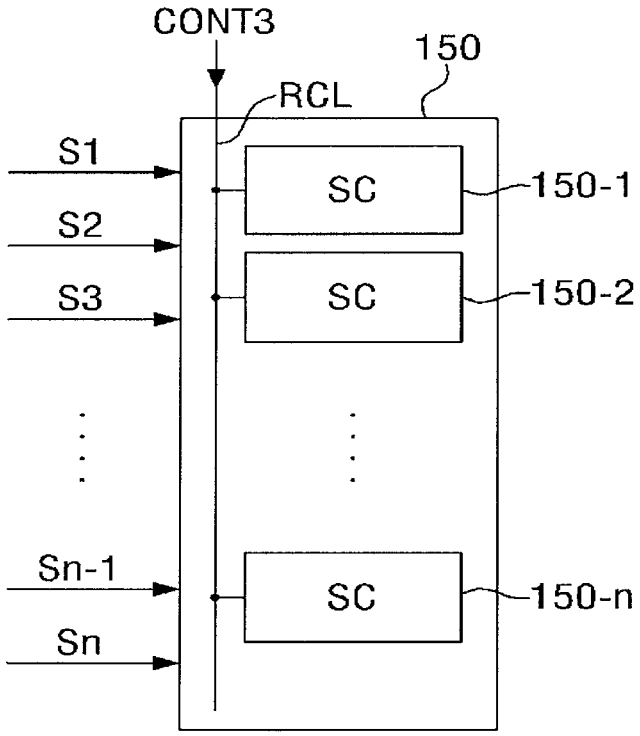
FIG. 4 is a block diagram of an example repair controller illustrated in FIG. 1 according to an embodiment of the present invention.
Figure 5:
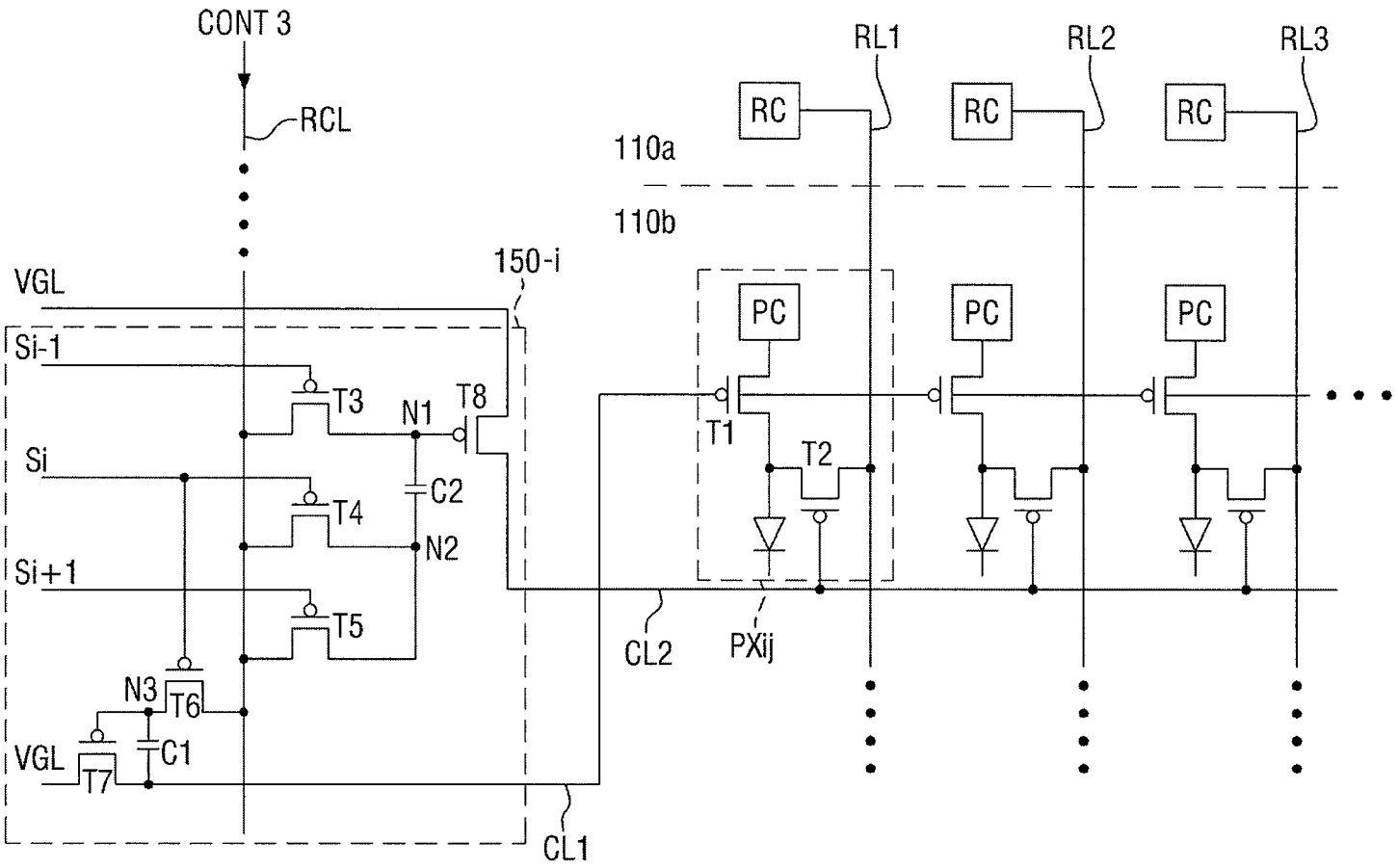
FIG. 5 is a circuit diagram of an example repair controller illustrated in FIG. 4 according to an embodiment of the present invention.
Figure 6:
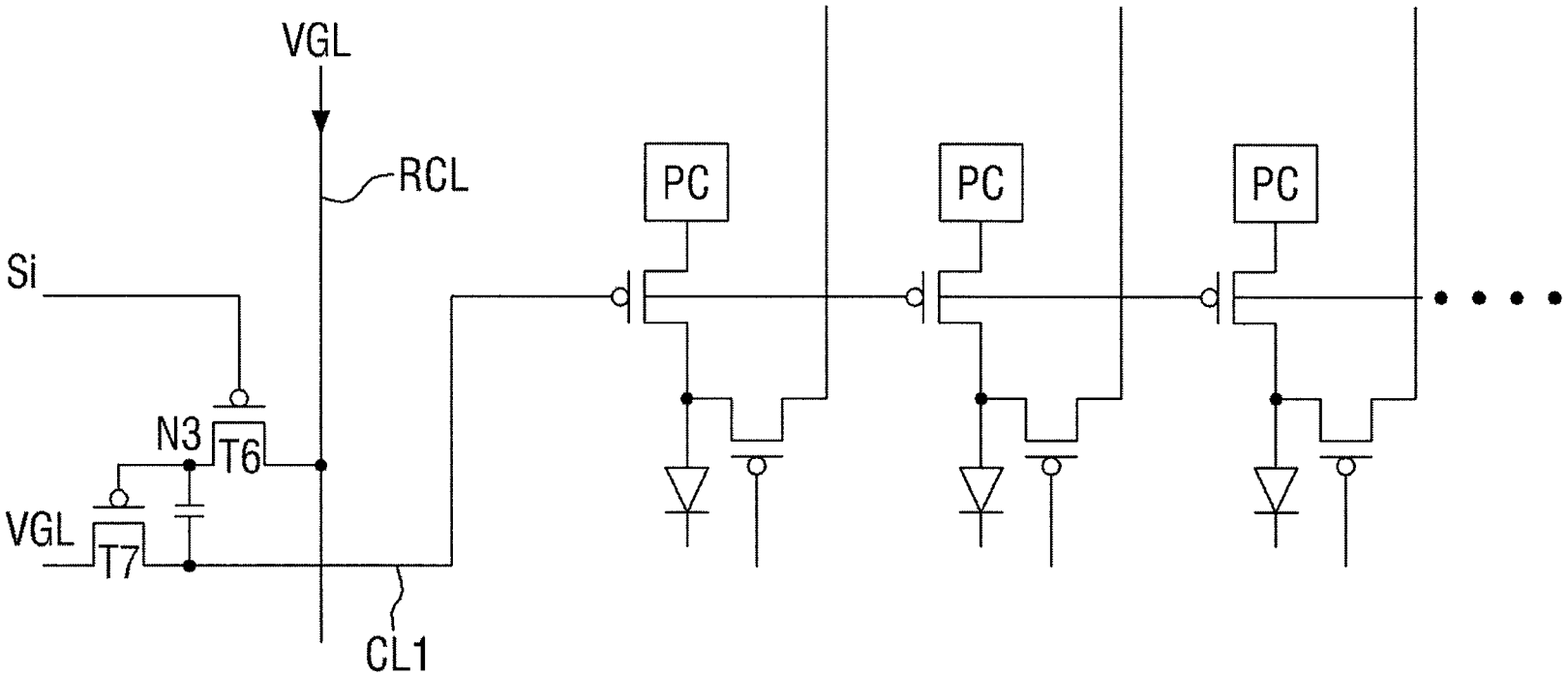
FIGS. 6 to 8 are circuit diagrams illustrating an example operation of the repair controller of FIG. 5 according to a third driving control signal in an embodiment of the present invention.
Figure 7:
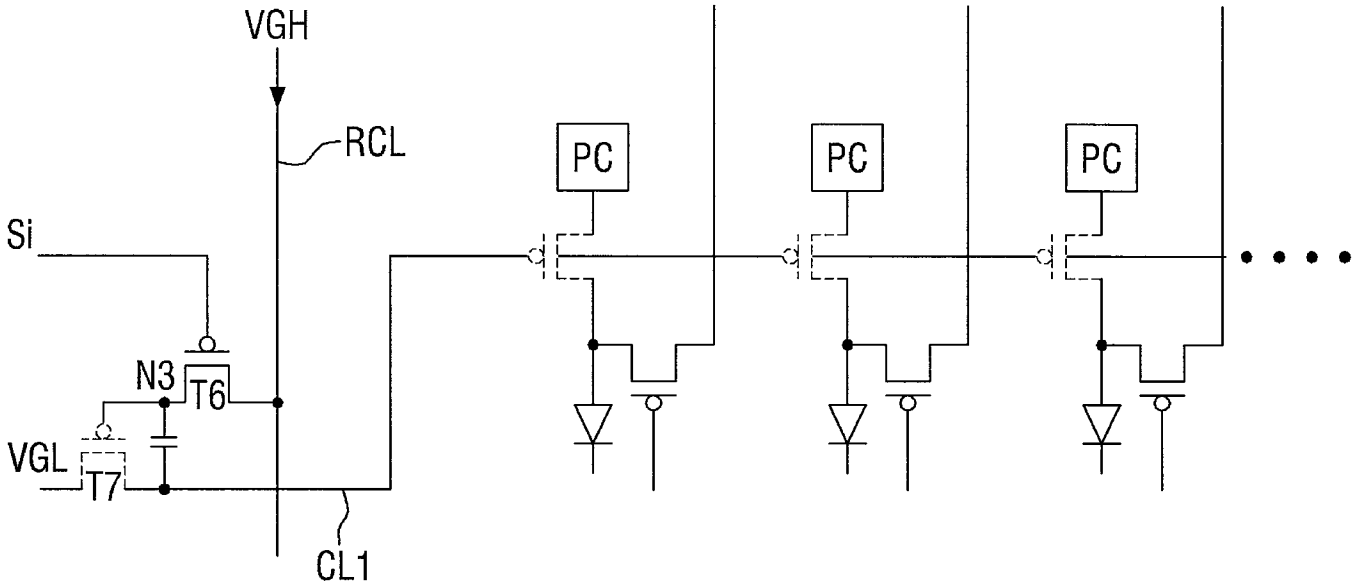
Figure 8:
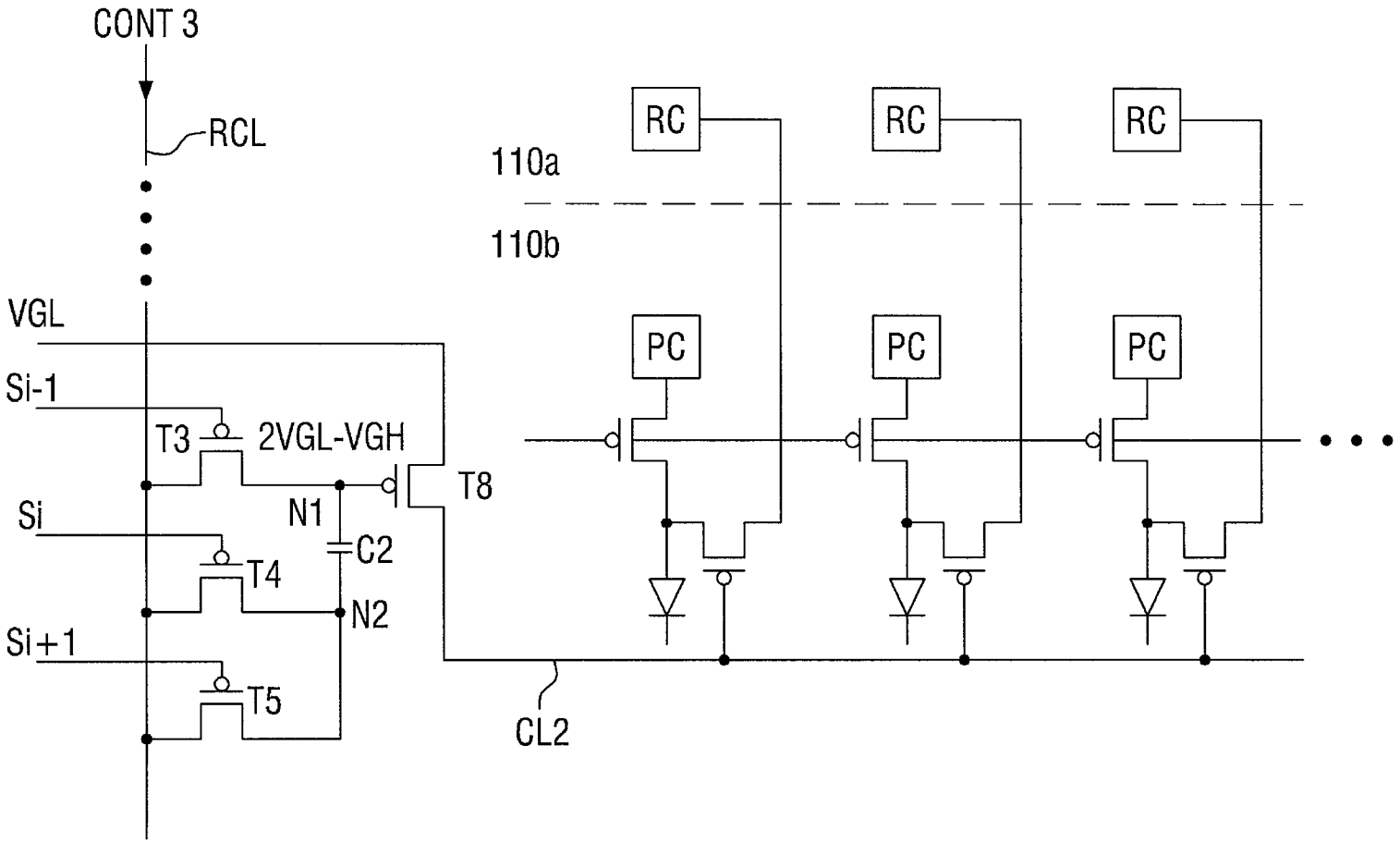
Figure 9:
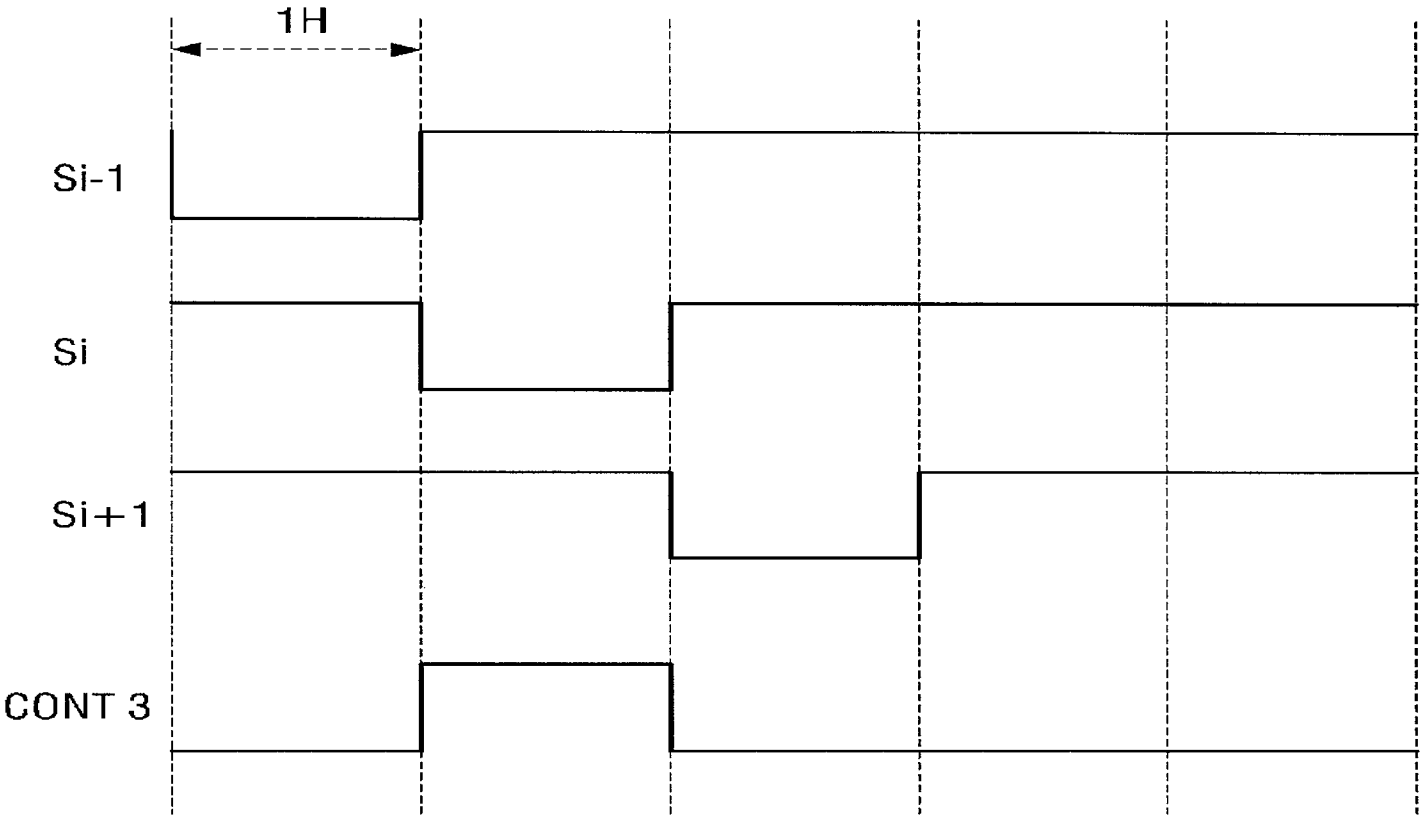
FIG. 9 is a timing diagram illustrating examples of a scan signal and the third driving control signal according to an embodiment of the present invention.

FIG. 4 is a block diagram of an example repair controller 150 illustrated in FIG. 1 according to an embodiment of the present invention, FIG. 5 is a circuit diagram of an example repair controller 150 illustrated in FIG. 4 according to an embodiment of the present invention, FIGS. 6 to 8 are circuit diagrams illustrating an example operation of the repair controller 150 of FIG. 5 according to the third driving control signal CONT3 in an embodiment of the present invention, and FIG. 9 is a timing diagram illustrating examples of a scan signal and the third driving control signal CONT3 according to an embodiment of the present invention.

Referring to FIGS. 4 to 9, the repair controller 150 may include a plurality of repair control elements 150-1 through 150-*n*. The number of repair control elements 150-1 through 150-*n* may correspond to the number of scan lines SL1 through SLn. In one embodiment, a first repair control element 150-1 may provide a control signal to a row of pixels PX connected to the first scan line SL1. The display panel 110 may include a plurality of first control lines CL1 and a plurality of second control lines CL2. A first control line CL1 and a second control line CL2 extended from each of the repair control elements 150-1 through 150-*n* may be connected to a row of pixels connected to a corresponding scan line. More specifically, a first control line CL1 and a second control line CL2 connected to, for example, the first repair control element 150-1, may be connected to the gate electrode of the first transistor and the gate electrode of the second transistor, respectively, of each of the pixels PX included in a first pixel row connected to the first scan line SL1.

The repair control elements 150-1 through **150-*n* may be connected to a repair control line RCL. The repair control line RCL may be provided with the third driving control signal CONT3 by the controller 120. The third driving control signal CONT3 with a low-level voltage VGL or a high-level voltage VGH may be provided at intervals of a single horizontal period 1H. The repair control elements 150-1 through 150-*n* may selectively control the connections between the pixel rows and the repair lines RL1, RL2, . . . , RLn according to the third driving control signal CONT3 with the low-level voltage VGL. The third driving control signal CONT3 may be a repair control signal. The repair controller 150 may be mounted on the display panel 110. That is, the repair control elements 150-1 through 150-*n* may be provided in the non-display area of the display panel 110 along the second direction d2**, but the present invention is not limited thereto.

FIG. 5 is a schematic circuit diagram illustrating the connections between an i-th pixel row (where i is a natural number greater than or equal to 1 and less than or equal to n) connected to the i-th scan line SLi, the repair circuits RC in the dummy pixel area **110*a*, and an i-th repair control element 150-*i*, which provides a control signal to the i-th pixel row. The structure of the i-th repair control element 150-*i*** may be directly applicable to the other repair control elements.

The i-th repair control element **150-*i* may include a plurality of transistors, but the present invention is not limited thereto. The i-th repair control element 150-*i* may include third through eighth transistors T3 through T8. In one embodiment, the first and second transistors T1 and T2 of each of the pixels PX included in the i-th pixel row and the third through eighth transistors T3 through T8 may be p-channel field effect transistors (FETs). That is, the first transistor T1 may be turned on by a scan signal with the low-level voltage VGL, and may be turned off by a scan signal with the high-level voltage VGH. However, the present invention is not limited to this example embodiment. In other embodiments, the first, second, and third transistors T1, T2, and T3** may be n-channel FETs.

An (i−1)-th scan signal Si−1, the i-th scan signal Si, and an (i+1)-th scan signal Si+1 may be applied to the i-th repair control element **150-*i*. First electrodes of the third, fourth, and fifth transistors T3, T4, and T5 may be connected to the repair control line RCL. The third, fourth, and fifth transistors T3, T4, and T5 may be turned on by the (i−1)-th scan signal Si−1, the i-th scan signal Si, and the (i+1)-th scan signal Si+1, respectively, and may transmit the third driving control signal CONT3** applied thereto via the repair control line RCL to second electrodes thereof.

The scan signals S1, S2, . . . , Sn may be sequentially output at intervals of the horizontal period 1H. The third transistor T3 may transmit the third driving control signal CONT3 to a first node N1 to which the second electrode of the third transistor T3 is connected, and the fourth and fifth transistors T4 and T5 may transmit the third driving control signal CONT3 to a second node N2 to which the second electrodes of the fourth and fifth transistors T4 and T5 are connected. Since the third driving control signal CONT3 may be provided at intervals of the horizontal period 1H as a low- or high-level voltage, the third, fourth, and fifth transistors T3, T4, and T5 may provide the third driving control signal CONT3 provided thereto during the same horizontal period 1H to the second electrodes thereof.

The sixth transistor T6 may be turned on by the i-th scan signal Si, and may transmit the third driving control signal CONT3 applied thereto via the repair control line RCL connected to the second electrode thereof to a third node N3.

A gate electrode of the seventh transistor T7 may be connected to the third node N3, and the low-level voltage VGL may be provided to a first electrode of the seventh transistor T7. A first capacitor C1 may be connected between the second electrode of the seventh transistor T7 and the third node N3. The first capacitor C1 may be charged with the voltage of the third driving control signal CONT3. The voltage that the first capacitor C1 is charged with may be supplied to the gate electrode of the seventh transistor T7. The second electrode of the seventh transistor T7 may be connected to a first control line CL1. The first control line CL1 may be connected to the gate electrode of the first transistor T1 of each of the pixels PX included in the i-th pixel row, wherein the first transistor T1 connects the pixel circuit PC and the display element EL of the corresponding pixel PX. A control signal provided via the first control line CL1 may be the low-level voltage VGL. That is, in each of the pixels PX included in the i-th pixel row, the pixel circuit PC and the display element EL may be connected together via the first transistor T1 in response to the seventh transistor T7 of the i-th repair control element **150-*i*** being turned on.

A gate electrode of the eighth transistor T8 may be connected to the first node N1, a first electrode of the eighth transistor T8 may be connected to a second control line CL2, and a second control signal with the low-level voltage VGL may be applied to the second electrode of the eighth transistor T8. The second control line CL2 connected to the eighth transistor T8 of the i-th repair control element **150-*i*, may be connected to the gate electrode of the second transistor T2 of each of the pixels PX included in the i-th pixel row connected to the i-th scan line SLi. That is, the second transistor T2** of each of the pixels PX included in the i-th pixel row may be turned on by a second control signal with the low-level voltage VGL so that the display element EL of each of the pixels PX included in the i-th pixel row may be connected to a corresponding repair circuit RC.

The seventh transistor T7 of the i-th repair control element **150-*i* may be controlled according to the voltage of the third driving control signal CONT3 provided to the repair lines RL1, RL2, . . . , RLn. That is, the sixth transistor T6 of the i-th repair control element 150-*i* may be turned on by the i-th scan signal Si. The third driving control signal CONT3 provided during the same horizontal period as the i-th scan signal Si, may be transmitted to the third node N3 via the sixth transistor T6. As illustrated in FIG. 6, the third driving control signal CONT3 with the low-level voltage VGL may turn on the seventh transistor T7, and may thus allow the low-level voltage VGL to be transmitted to the first control line CL1. As a result, the pixel circuit PC and the display element EL of each of the pixels PX included in the i-th pixel row may continue to be connected together. As illustrated in FIG. 7, the third driving control signal CONT3 with the high-level voltage VGH may turn off the seventh transistor T7**. As a result, the connection between the pixel circuit PC and the display element EL of each of the pixels PX included in the i-th pixel row may be disconnected.

The controller 120 may provide the third driving control signal CONT3 with the high-level voltage VGH to the repair control line RCL during the application of a scan signal to a scan line to which a defective pixel PX is connected. For example, after a defect occurs in a pixel PX connected to the i-th scan line SLi, the third driving control signal CONT3 with the high-level voltage VGH may be output during the same horizontal period as the i-th scan signal Si. That is, by selectively providing the third driving control signal CONT3 with the high-level voltage VGH to the repair control line RCL, the connection between the pixel circuit PC and the display element EL of the defective pixel PX connected to the i-th scan line SLi may be selectively cut off. Since the first control line CL1 is connected to the gate electrode of the first transistor T1 of each of the pixels PX included in the i-th pixel row to which the i-th scan signal Si is applied, the connection between the pixel circuit PC and the display element EL of each of the pixels PX included in the i-th pixel row may all be disconnected.

In addition, by selectively providing the third driving control signal CONT3 to the repair control line RCL, the display element EL of a pixel PX where a defect has occurred and a corresponding repair circuit RC may be selectively connected. For example, after a defect occurs in a pixel PX connected to the i-th scan line SLi, the third driving control signal CONT3 with the high-level voltage VGH may be output during the same horizontal period as the i-th scan signal Si, and the third control signal CONT3 with the low-level voltage VGL may be applied as the (i−1)-th scan signal Si−1 and the (i+1)-th scan signal Si+1.

The third transistor T3 may be turned on by the (i−1)-th scan signal Si−1, and may transmit the low-level voltage VGL to the first node N1. The low-level voltage VGL may also be applied to the second electrode of the eighth transistor T8, and thus, the eighth transistor T8 may not be turned on. The fourth transistor T4 may be turned on by the i-th scan signal Si, which follows the (i−1)-th scan signal Si−1, and may provide the high-level voltage VGH to the second node N2. The second capacitor C2 may be charged with a voltage corresponding to the difference between the voltage at the first node N1 and the voltage at the second node N2.

The fifth transistor T5 may be turned on by the (i+1)-th scan signal Si+1, and may provide the low-level voltage VGL to the second node N2. That is, the voltage at the second node N2 may be switched from the high-level voltage VGH to the low-level voltage VGL, and the second capacitor C2 may couple the voltage at the first node N1 according to a variation in the voltage at the second node N2. The voltage level at the first node N1 may be 2VGL-VGH. That is, the first node N1 may be charged with a much lower-level voltage, and as a result, the eighth transistor T8 may be turned on. In response to the eighth transistor T8 being turned on, the low-level voltage VGL may be provided to the second control line CL2, and may thus turn on the second transistor T2 of each of the pixels PX included in the i-th pixel row.

More specifically, since the second control line CL2 is connected to the gate electrode of the second transistor T2 of each of the pixels PX included in the i-th pixel row, the display element EL of each of the pixels PX included in the i-th pixel row may all be connected to the repair circuit RC of a dummy pixel DPX via the turned-on second transistor T2 of each of the pixels PX included in the i-th pixel row. That is, in each of the pixels PX included in the i-th pixel row, in response to the first transistor T1 being turned off, the display element EL may be disconnected from the pixel circuit PC, and may be connected to the corresponding repair circuit RC via the turned-on second transistor T2. As a result, the display element EL of each of the pixels PX included in the i-th pixel row may generate light based on a driving current provided thereto via a corresponding repair circuit RC.

The display device 10 may selectively cut off the connection between the pixel circuit PC and the display element EL of a pixel PX where a defect has occurred, by controlling the repair control elements 150-1 through **150-*n*. That is, even if a defect occurs in the pixel circuit PC of a pixel PX, no pixel defect may result since a repair circuit RC may be driven instead of the pixel circuit PC of the defective pixel PX. In addition, since the pixel circuit PC of the defective pixel PX is blocked by using the repair control elements 150-1 through 150-*n* without the need of the application of laser or physical force, the display device 10** may be prevented from being damaged by the application of laser or physical force.

While the present invention has been particularly shown and described with reference to example embodiments thereof, it will be understood by those of ordinary skill in the art that various changes may be made therein without departing from the spirit and scope of the invention as defined by the following claims, and equivalents thereof. The example embodiments should be considered in a descriptive sense only and not for purposes of limitation.

What is claimed is:

1. A display device comprising:

a first pixel comprising a display element, a pixel circuit to provide a driving signal to the display element, a first transistor to control a connection between the pixel circuit and the display element, and a second transistor to control a connection between the display element and a repair line;

a second pixel comprising a repair circuit to provide the driving signal to the repair line; and a repair control element connected to first and second control lines that are connected to gate electrodes of the first and second transistors, respectively, and configured to control the first and second transistors according to a repair control signal provided by a controller, wherein the repair control element comprises:

third through fifth transistors each having a first electrode connected to a repair control line configured to receive the repair control signal;

a sixth transistor having a second electrode connected to the repair control line and configured to turn on by an i-th scan signal being applied to the first pixel;

a seventh transistor having a gate electrode connected to a first electrode of the sixth transistor, a first electrode configured to receive a first control signal with a low-level voltage, and a second electrode connected to the first control line;

an eighth transistor having a gate electrode connected to a second electrode of the third transistor, a second electrode configured to receive a second control signal with the low-level voltage, and a first electrode connected to the second control line;

a first capacitor connected between the second electrode of the third transistor and a second electrode of the fourth transistor; and a second capacitor connected between the second electrode and the gate electrode of the seventh transistor.

2. The display device of claim 1, wherein the third transistor is configured to turn on by an (i−1)-th scan signal preceding the i-th scan signal, the fourth transistor is configured to turn on by the i-th scan signal, and the fifth transistor is configured to turn on by an (i+1)-th scan signal following the i-th scan signal.

3. The display device of claim 2, wherein after a defect occurs in the pixel circuit of the first pixel, the controller is configured to sequentially output the repair control signal with the low-level voltage, the repair control signal with a high-level voltage, and the repair control signal with the low-level voltage concurrently with the (i−1)-th scan signal, the i-th scan signal, and the (i+1)-th scan signal, respectively.

4. The display device of claim 1, wherein the seventh transistor is configured to turn off by the repair control signal with a high-level voltage being provided thereto via the sixth transistor.

* * * * *